United States Patent [19]

Kebedjis

[11] Patent Number: 4,502,841

[45] Date of Patent: Mar. 5, 1985

[54] FAN BLADE AXIAL LOCKING DEVICE

[75] Inventor: Georges Kebedjis, Alfortville, France

[73] Assignee: S.N.E.C.M.A., Paris, France

[21] Appl. No.: 542,973

[22] Filed: Oct. 18, 1983

[30] Foreign Application Priority Data

Nov. 8, 1982 [FR] France ..... 82 18652

[51] Int. Cl.[3] ..... F01D 5/08

[52] U.S. Cl. ..... 416/220 R

[58] Field of Search ..... 416/220 R, 221, 220 A

[56] References Cited

U.S. PATENT DOCUMENTS

| | | | |
|---|---|---|---|
| 2,949,278 | 9/1960 | McCormick | 416/220 R |
| 3,656,865 | 4/1972 | Spears | 416/220 |
| 3,734,646 | 5/1973 | Perkins | 416/220 |
| 3,748,060 | 7/1973 | Hugoson et al. | 416/220 R |
| 4,033,705 | 7/1977 | Luebering | 416/220 |

FOREIGN PATENT DOCUMENTS

| | | | |
|---|---|---|---|
| 61948 | 6/1982 | European Pat. Off. | 416/220 R |
| 2013647 | 4/1970 | France | 416/220 R |
| 2345605 | 10/1977 | France | 416/220 R |
| 739870 | 11/1955 | United Kingdom | 416/220 R |
| 445753 | 6/1975 | U.S.S.R. | 416/193 A |

*Primary Examiner*—Henry C. Yuen
*Assistant Examiner*—John Kwon
*Attorney, Agent, or Firm*—Oblon, Fisher, Spivak, McClelland & Maier

[57] ABSTRACT

An axial locking device for blades of a fan, each blade including a root of dovetail or other re-entrant form engageable by axial sliding in corresponding grooves of the rim of the fan disc. A locking member is provided in the form of a key of parallelepiped form abutting the root of the blade. The key is locked against radially outward motion by a peripheral extension from one longer edge which engages a tab member having a portion which is secured to a front face of the fan rim. The key engages radial slots in the rim and in an alternative embodiment, the key is secured radially by a bolt which passes through a forward part of the rim, an end portion of the key and into a tapped bore of the main body of the rim.

3 Claims, 2 Drawing Figures

FAN BLADE AXIAL LOCKING DEVICE

BACKGROUND OF THE INVENTION

Field of the Invention

The present invention relates to a fan-blade axial locking device.

Summary of the Prior Art

In order to provide for the axial locking of blades on a rotor disc of a gas turbine, various devices are known.

U.S. Pat. No. 4,033,785 relates to a device in which the rotor disc comprises at its periphery teeth having radial recesses disposed one facing the other and in which is engaged a locking member in the form of a dovetail against which abuts through a resilient member the root of the blade, the said locking member having feet which abut against an annular ring secured on the upstream face of the disc. Such a device has, however, a degree of complexity which gives rise to a high manufacturing cost of the parts by which it is formed.

Nevertheless, rapid disassembly and location of a single blade is impossible with this device, since it requires that all the fixing pins of the flanges of the annular ring need to be withdrawn.

U.S. Pat. No. 3,656,865 relates to a locking device for blades comprising a plurality of retention plates located in a groove of the teeth of the disc; a claw of the foot of the blade preventing axial movement from upstream in the downstream direction.

However, in this proposal, the retention plate is located in a closed circumferential groove in the direction of the centre and not in radial slots open in the direction of the centre.

Furthermore, the retention plate requires for securing in place a second circumferential groove provided in a collar at the upstream face of the disc.

The introduction or the retraction of the retaining plate in the grooves is effected by deformation, which prevents the use of a thick plate and has a strength equal to that which is desired.

French Pat. Nos. 2 013 647 and 2 345 605 relate to a device in which the root of the blade carries a nose which is provided with radial slots corresponding to the grooves of the teeth and in which is engaged a locking member of U-shape. Locking is thus not provided by simple abutment against the root of the blade.

The present invention has for its object to overcome these disadvantages and to provide a simple device enabling the disassembly and the reassembly separately for each of the blades.

SUMMARY OF THE INVENTION

According to the present invention, there is provided an axial locking device for a blade assembly of a fan, the fan having a rotor disc with an axial groove of reentrant form in the rim thereof and the blade having a root of a form corresponding to that of the groove and being engaged therein by axial sliding, lug means rigid with the blade root and abutting the upstream face of the disc, teeth formed in the upstream face of the disc adjacent the periphery thereof, and having in each tooth a radial slot facing a corresponding radial slot of an adjacent tooth, locking means engaged in opposed slots whereby axially to lock the said blade root, a key of parallelepiped form serving as said locking means and arranged in abutting relationship with the blade root and means serving to lock the key against radially outward motion.

Two adjacent keys are preferably held radially by a tab member of which an intermediate branch is secured against the upstream face of the tooth and of which a transverse branch is in abutment beneath one limb of the key extending in the axial direction the larger upstream face of said key.

The parallelepiped part of the key may comprises, at at least one of its circumferential ends, a bore perpendicular to the face of the tooth in which it is engaged, said tooth comprising itself a bore corresponding to and aligned with the bore of the key for the introduction into these bores of at least one key securing device. This arrangement enables the provision of a locking device which is simpler than the existing and previously proposed devices, particularly regarding the securing of the key in the centrifugal sense.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
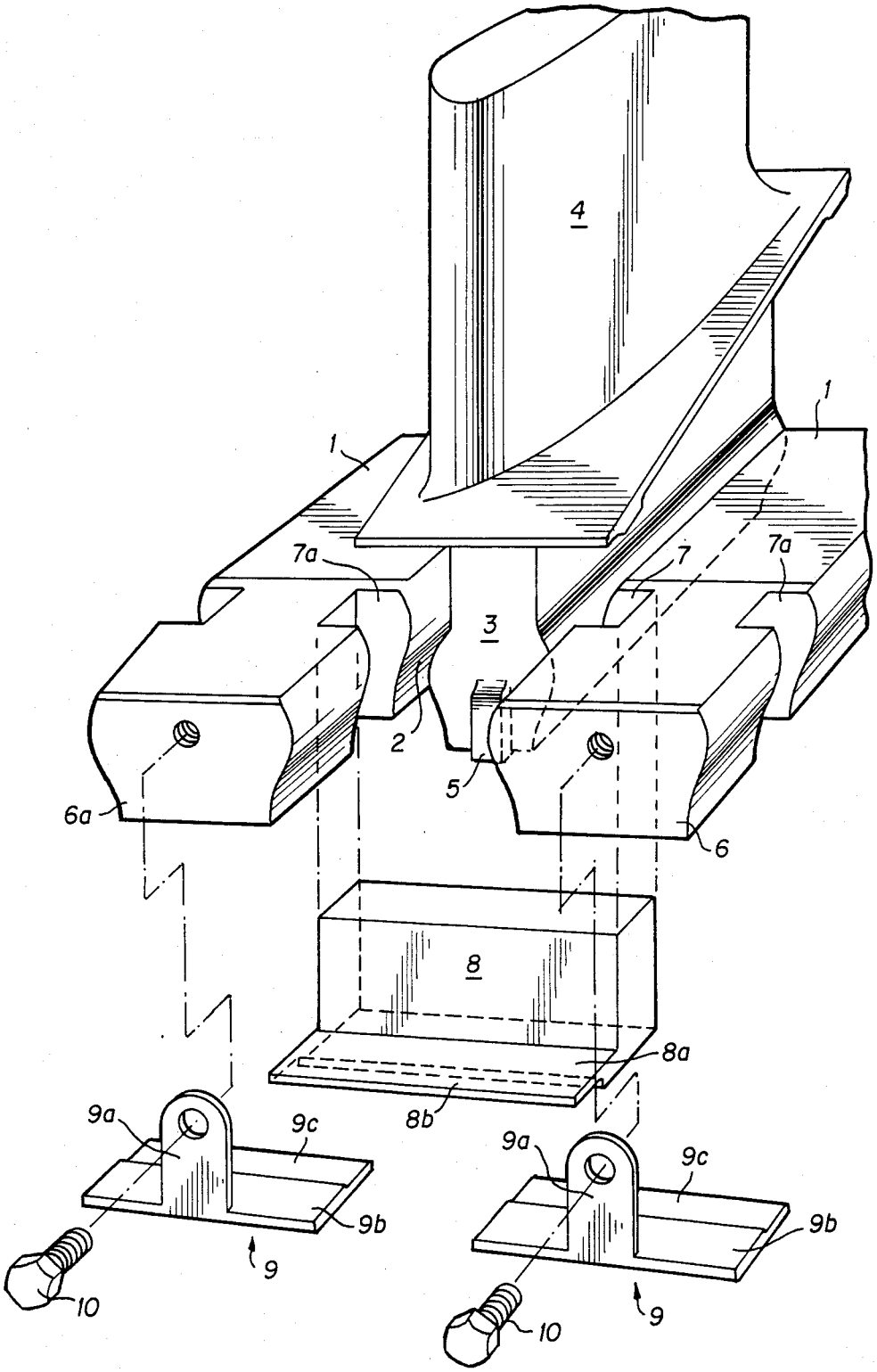
FIG. 1 is a perspective, exploded view of one embodiment of an axial, blade-locking device in accordance with the invention.
Figure 2:
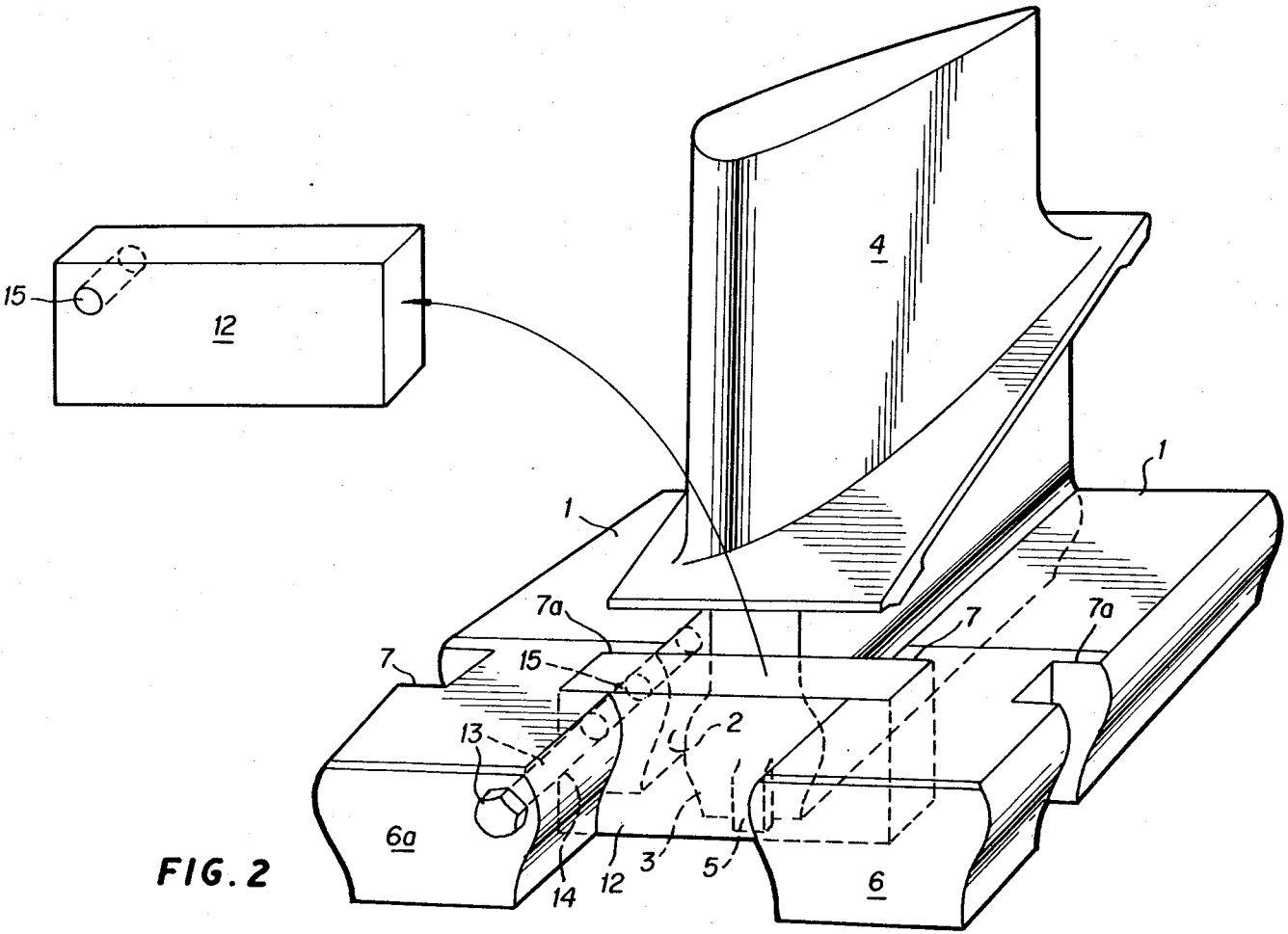
FIG. 2 is a perspective view of a second embodiment of axial, blade-locking device in accordance with the invention.

A disc 1 of a rotor of a fan having a rim in which are formed grooves 2 of dovetail section, is illustrated in FIGS. 1 and 2.

A root 3 of a blade 4 of the fan is engaged in each of the grooves 2 by axial sliding and the root has a section likewise of generally dovetail shape, corresponding to that of groove 2.

The root carries a lug 5 which, when assembled, abuts against the upstream face of the disc 1 and prevents axial movement of the blade from upstream thereof in the downstream direction. The dovetail section is not essential and can be replaced by any other re-entrant section which permits axial sliding but prevents radial movement.

The rim of disc 1 has at its periphery, teeth 6, **6*a* disposed on opposite sides of each groove 2 and extending axially forwardly, the teeth being provided with radial slots 7, 7*a* disposed one opposite another and in which is located an axial locking member acting on the root 3 of the blade. The locking member is constituted by a parallelepiped key 8 of rectangular form against which the root 3 of the blade 4** abuts.

The key 8 is locked radially outwardly by a tab member 9 of which an upstanding branch **9*a* is secured by means of a bolt 10 against the upstream face of the tooth 6, 6*a* and of which a transverse branch 9*b* perpendicular to the branch 9*a* abuts a limb extension 8*a*** of the key extending in the axial direction from the longer upstream face of the key.

The limb **8*a* of the key and the branch 9*b* of the tab member 9 have a thinner part 8*b* on the limb 8*a* and 9*c* on the branch 9*b*, in order to facilitate the superposition of the limb and of the branch. The tab member 9 thus provides for the radial securing of the two adjacent keys 8** of each tooth, such as *6a*.

According to the second embodiment illustrated in FIG. 2, the axial locking member of the root 3 of the blade 4 is constituted by a parallelepiped key 12 of rectangular form which is engaged, at its ends, in the two radial grooves 7, *7a* of the teeth, 6, *6a*, the root 3 of the blade abutting against an intermediate part of the key 12.

The key 12 is locked radially adjacent one of its circumferential ends by a bolt 13 with a head engaged in aligned bores 14 and 15 provided in the tooth *6a* and in the key 12.

The bore 15 of the key is perpendicular to the face of the tooth *6a* in which the key is engaged.

The headed bolt 13 is screwed into a tapped hole provided in the upstream face of the disc 1.

Obviously, numerous modifications and variations of the present invention are possible in light of the above teachings, it is therefore to be understood that within the scope of the appended claims, the invention may be practiced otherwise than as specifically described herein.

What is claimed as new and desired to be secured by Letters Patent of the United States is:

1. An axial locking device for a blade assembly of a fan, the fan having a rotor disc with an axial groove of reentrant form in a rim thereof and each blade having a root of a form corresponding to that of the groove and being engaged therein by axial sliding, comprising:

lug means rigid with the blade root and abutting an upstream face of the disc, a first and second adjacent tooth formed in an upstream face of the disc adjacent the periphery thereof, and having in said first tooth a radial slot facing a corresponding radial slot of said second tooth, and locking means engaged in said slots of said first and second tooth for axially locking said blade root wherein said locking means further comprises a key of parallelepiped form arranged in abutting relationship with said blade root, means for locking said key against radially outward motion, a forward extension portion extending from a longer edge portion of the key and lying at least in part radially inwardly of and in abutting relationship with radially inner surfaces of said first and second teeth and tab means operatively associated with each said tooth and wherein each said tab means further comprises a portion engaging and secured to an upstream face of an associated tooth, and a portion engaging and lying radially inwardly of the said forward extension portion of the key.

2. An axial locking device for a blade assembly of a fan, the fan having a rotor disc with an axial groove of reentrant form in a rim thereof and each blade having a root of a form corresponding to that of the groove and being engaged therein by axial sliding, comprising:

lug means rigid with the blade root and abutting an upstream face of the disc, a first and second adjacent tooth formed in an upstream face of the disc adjacent the periphery thereof, and having in said first tooth a radial slot facing a corresponding radial slot of said second tooth, and locking means engaged in said slots of said first and second tooth for axially locking said blade root wherein said locking means further comprises a key of parallelepiped form arranged in abutting relationship with said blade root, means for locking said key against radially outward motion and means defining an aligned bore through one of said first and second teeth, through an end portion of the key itself and with the material of the fan rim, and securing means extending through said aligned bore.

3. A device according to claim 2, wherein said securing means further comprises a headed bolt and said means defining said aligned bore in the fan rim is tapped and receives an end portion of said bolt.

* * * * *